US009716349B1

(12) United States Patent
Wang et al.

(10) Patent No.: US 9,716,349 B1
(45) Date of Patent: Jul. 25, 2017

(54) ELECTRIC CONNECTOR

(71) Applicant: Allsmartlite Technology Co., Ltd., Shenzhen (CN)

(72) Inventors: Xiaoping Wang, Shenzhen (CN); Ming-Han Perng, Shenzhen (CN); Chien-Hsing Lai, Shenzhen (CN)

(73) Assignee: ALLSMARTLITE TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/237,628

(22) Filed: Aug. 15, 2016

(51) Int. Cl.

| | |
|---|---|
| ***H01R 13/6594*** | (2011.01) |
| ***H01R 13/631*** | (2006.01) |
| ***H01R 24/62*** | (2011.01) |
| *H01R 107/00* | (2006.01) |

(52) U.S. Cl.
CPC ..... *H01R 13/6594* (2013.01); *H01R 13/631* (2013.01); *H01R 24/62* (2013.01); *H01R 2107/00* (2013.01)

(58) Field of Classification Search
CPC .. H01R 13/631; H01R 13/6594; H01R 24/62; H01R 2107/00; H01R 13/465; H01R 13/6583; H01R 13/6584; H01R 13/65802; H01R 13/13629
USPC ..... 439/83, 95, 491, 607.17–607.19, 607.4
See application file for complete search history.

(56) References Cited

U.S. PATENT DOCUMENTS

| | | | | |
|---|---|---|---|---|
| 2,043,919 | A * | 6/1936 | Bengtson | H01B 13/344 24/1 |
| 5,009,617 | A * | 4/1991 | Thomas | A61C 19/004 439/239 |
| 5,267,882 | A * | 12/1993 | Davis | H01R 13/64 439/680 |
| 5,397,252 | A * | 3/1995 | Wang | H01R 13/6625 333/185 |
| 5,785,557 | A * | 7/1998 | Davis | H01R 13/26 439/108 |
| 6,135,815 | A * | 10/2000 | Ko | H01R 13/6315 439/607.01 |
| 6,390,847 | B2 * | 5/2002 | Katwala | H01R 13/465 439/491 |
| 6,821,164 | B2 * | 11/2004 | Mills | H01R 13/11 439/825 |
| 7,351,070 | B2 * | 4/2008 | Hirai | H05K 3/365 439/157 |
| 8,053,667 | B2 * | 11/2011 | Chen | H05K 9/0058 174/50 |

(Continued)

*Primary Examiner* — Tulsidas C Patel
*Assistant Examiner* — Travis Chambers
(74) *Attorney, Agent, or Firm* — Leong C. Lei

(57) ABSTRACT

An electric connector structure, being a female connector, includes: a metal shell, including a upper surface defined on an inner side of thereof, two side surfaces extended from two respective end edges of the upper surface opposite to each other, and a lower surface extended from one side of each side surface far away from the upper surface; a plurality of first protrusions, respectively formed on the upper surface and lower surface; and a plurality of second protrusions, respectively formed on the two side surfaces and staggered with the first protrusions. Therefore, when a male connector is inserted in the female connector, the first and second protrusions are in contact with the outer wall of the male connector, thereby increasing insertion stability and generate multi-step noise blockage.

7 Claims, 7 Drawing Sheets

(56) References Cited

U.S. PATENT DOCUMENTS

| | | | | |
|---|---|---|---|---|
| 9,028,269 | B2 * | 5/2015 | Hsu | H01R 13/518<br>439/357 |
| 9,325,100 | B2 * | 4/2016 | Hirschy | H01R 13/6595 |
| 2013/0244451 | A1 * | 9/2013 | Cutsforth | H01R 39/41<br>439/29 |
| 2014/0322991 | A1 * | 10/2014 | Nakamura | H01R 13/20<br>439/862 |

* cited by examiner

ELECTRIC CONNECTOR

(a) TECHNICAL FIELD OF THE INVENTION

The present invention relates to an electric connector structure, and more particularly to an electric connector structure with good insertion stability and better noise isolation effect.

(b) DESCRIPTION OF THE PRIOR ART

Antenna is an indispensable element in a mobile device supporting a wireless communication function. However, it must be noted that antenna elements are susceptible to surrounding electromagnetic noise interference; they are susceptible to surrounding noise interference especially when a data transmission interface is in electric connection with an external connector. In order to have a better protection of a connector and prevent a magnetic field generated by a connector itself from affecting other electronic elements, a connector plastic core is generally coated with an outer shield shell (metal shell) to mask magnetic fields.

Taking a female connector as an example, the shield shell of a male connector is in mutual staggered connection with the one of the female connector upon the insertion of the male connector, allowing internal conductor sets to have electric connections. However, not only shaking will be generated because of the overlarge gap between the male and female connectors, causing the insertion times to be reduced substantially, but noise such as electromagnetic interference (EMI) or radio frequency interference (RFI) will be generated to affect the signal transmission quality in the process of the action.

The female connector mentioned above has the following problems and defects upon use:

1. it is easy to be shaken and unstable while being butted to a male connector; and
2. noise such as EMI and RFI will be generated in the process of the insertion.

SUMMARY OF THE INVENTION

To overcome the defects mentioned above, the present invention is proposed.

The main object of the present invention is to provide an electric connector structure, configuring a plurality of protrusions spaced at intervals on the inner side wall of a metal shell, thereby increasing an insertion stability and noise isolation degree.

To achieve the object mentioned above, the present invention proposes a female connector, including: a metal shell, including a upper surface defined on an inner side of thereof, two side surfaces extended from two respective end edges of the upper surface opposite to each other, and a lower surface extended from one side of each side surface far away from the upper surface; a plurality of first protrusions, respectively formed on the upper surface and lower surface; and a plurality of second protrusions, respectively formed on the two side surfaces and staggered with the first protrusions. Whereby, when a user makes an electric connector basing on the present invention, they form a plurality of first and second protrusions not in connection with each other on each surface of the metal shell and arrange the first and second protrusions spaced at intervals on the inner side wall of the metal shell. Therefore, when a male connector is inserted in the female connector, the first and second protrusions are in contact with the outer wall of the male connector, thereby increasing insertion stability and generate multi-step noise blockage.

DETAILED DESCRIPTION OF THE PREFERRED EMBODIMENTS

Figure 1:
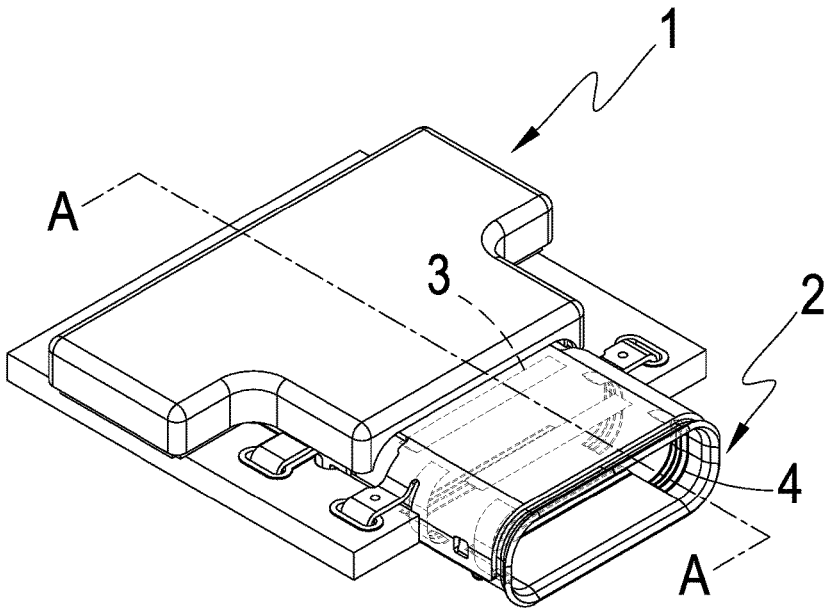
FIG. 1 is a perspective view of a preferred embodiment according to the present invention.
Figure 2:
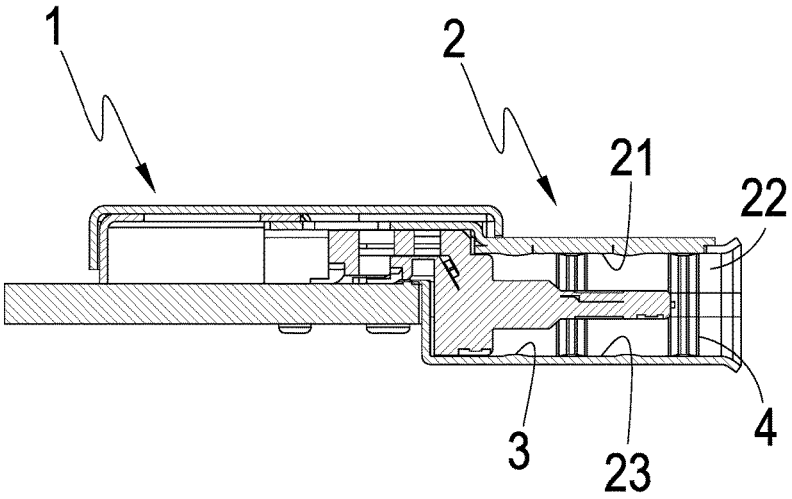
FIG. 2 is a cross-sectional view of the embodiment of the present invention taken along line A-A of FIG. 1.
Figure 3:
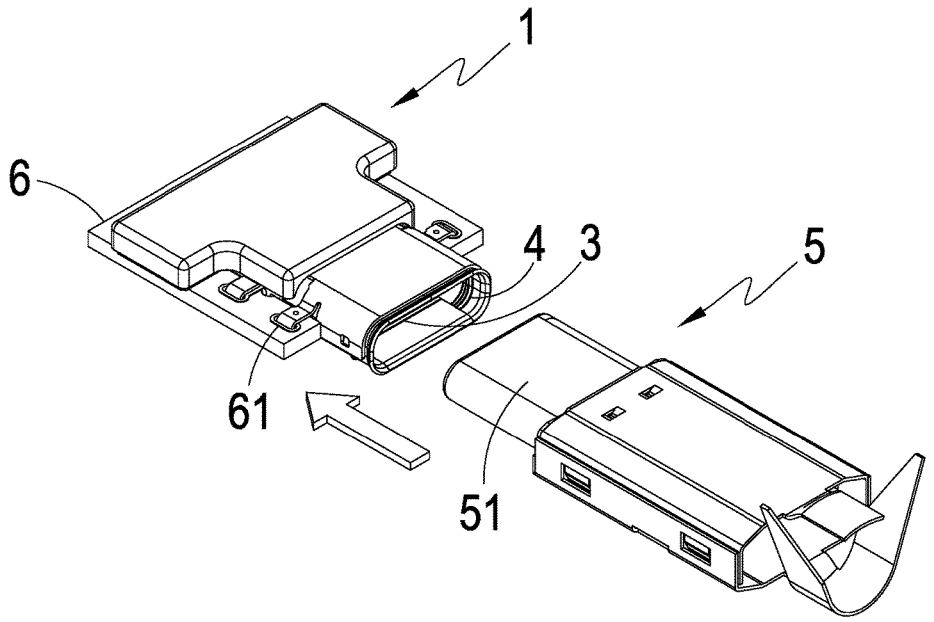
FIG. 3 is a perspective view of the embodiment of the present invention in an action state.

Referring to FIGS. 1 to 3, which respectively are a perspective view, cross-sectional view taken along line A-A of FIG. 1 and perspective view of the implementation of a preferred embodiment of the present invention, it can be seen clearly that a female connector 1 of the present invention includes:

a metal shell 2, including a upper surface 21 defined on the inner side of the metal shell 2, two side surfaces 22 extended from the two respective end edges of the upper surface 21 opposite to each other and a lower surface 23 extended from one side of each side surface 22 far away from the upper surface 21;

a plurality of first protrusions 3, respectively formed on the upper surface 21 and lower surface 23; and a plurality of second protrusions 4, respectively formed on the two side surfaces 22 and staggered with first protrusions 3, the first protrusions 3 and second protrusions 4 being in electric connection with a grounding portion 61 configured on a circuit board 6.

Furthermore, the first and second protrusions 3, 4 are in contact with an outer side wall 51 of a male connector 5 when the male connector 5 is inserted in the female connector 1.

According to the structure mentioned above, the corresponding matching thereof can further get advantages such as good insertion stability and better noise isolation effect, the detail will be describe as the following.

Figure 4:
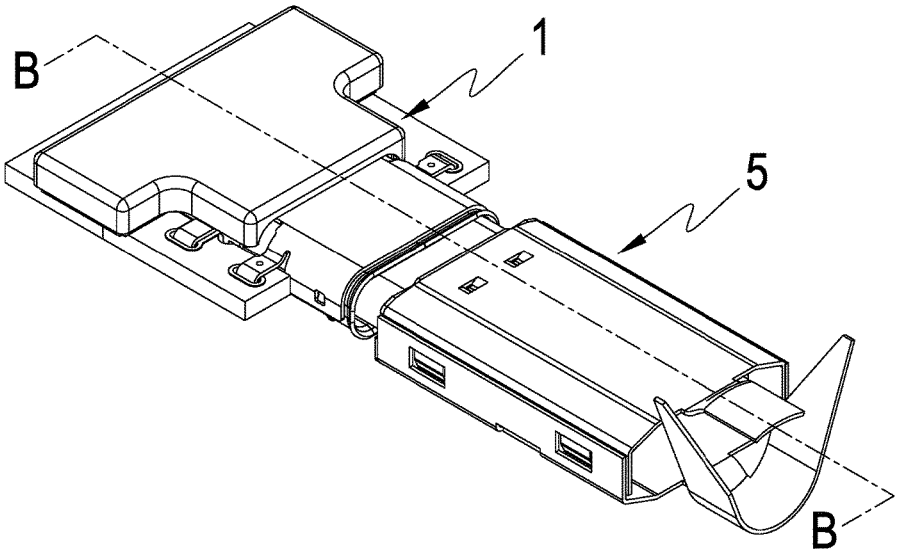
FIG. 4 is a perspective view of the embodiment of the present invention in a use state.
Figure 5:
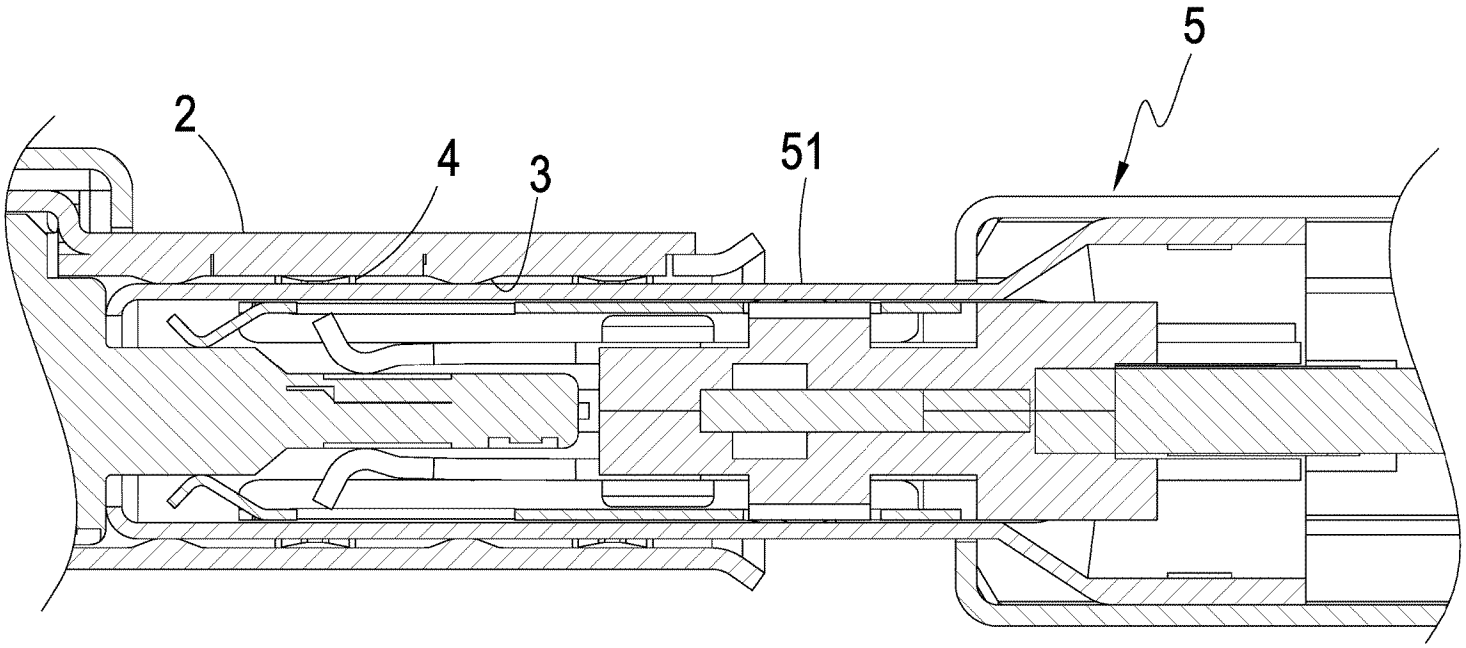
FIG. 5 is a cross-sectional view of the embodiment of the present invention taken along line B-B of FIG. 4.

Referring to FIGS. 1 to 5, which respectively are a perspective view, cross-sectional view taken along line A-A of FIG. 1, perspective view of the implementation, perspective view in a use state and cross-sectional view taken along line B-B of FIG. 4 of the embodiment of the present invention, it can be clearly seen from the figures from the component configurations mentioned above that each inner side wall of the metal shell 2 is formed with either first protrusions 3 or second protrusions 4 both being not in connection with each other, and in the embodiment, the areas of the first protrusions 3 and second protrusions 4 in contact with the outer side wall 51 of the male connector 5 are allowed to be larger and more uniform by forming the first protrusions 3 on the upper surface 21 and lower surface 23 symmetrically and the second protrusions on the left and right side walls 22 symmetrically so as to prevent the female connector 1 and male connector 5 from being unstable upon the butt joint thereof and terminals from being short-circuited. In addition, the female connector 1 allows the large current to be passed through so that quick recharge can be achieved because the first protrusions 3 and second protrusions 4 are in electric connection with a grounding portion 61 configured on a circuit board 6 through the metal shell 2.

Furthermore, although the first protrusions 3 and second protrusions 4 are not connected with each other to cause the space between the metal shell 2 and male connector 5 not to be sealed completely, multi-step noise blockage can be generated to make up for its unsealed structure and still have a good effect of isolating electromagnetic interference (EMI) or radio frequency interference (RFE) because the first protrusions 3 and second protrusions 4 are staggered with each other.

Figure 6:
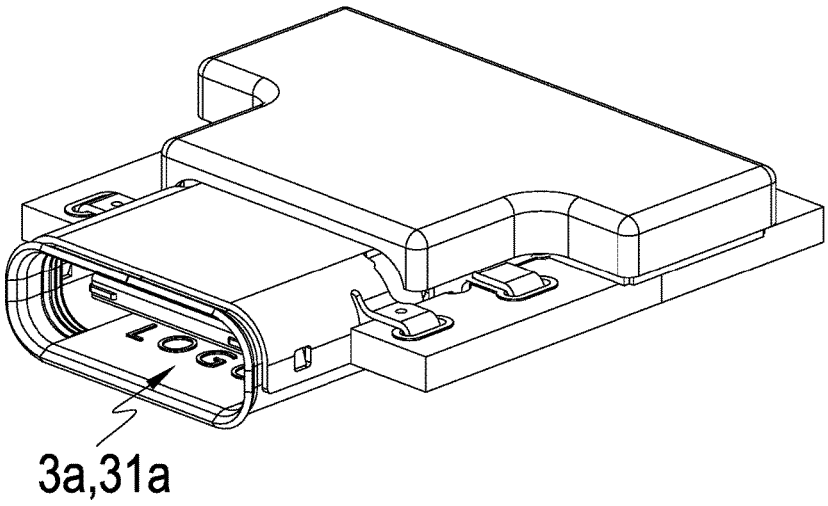
FIG. 6 is a perspective view of another preferred embodiment of the present invention.

Referring to FIG. 6, which is a perspective view of another preferred embodiment of the present invention, it is clearly seen from the figure that the present embodiment is similar to the embodiment mentioned above except first protrusions 3*a* include a first graphic portion 31*a* in the present embodiment, allowing the appearance of the first protrusions 3*a* to have a different appearance modeling, where the first graphic portion 31*a* may be presented as a trademark logo to generate a certain degree of advertising benefit.

Figure 7:
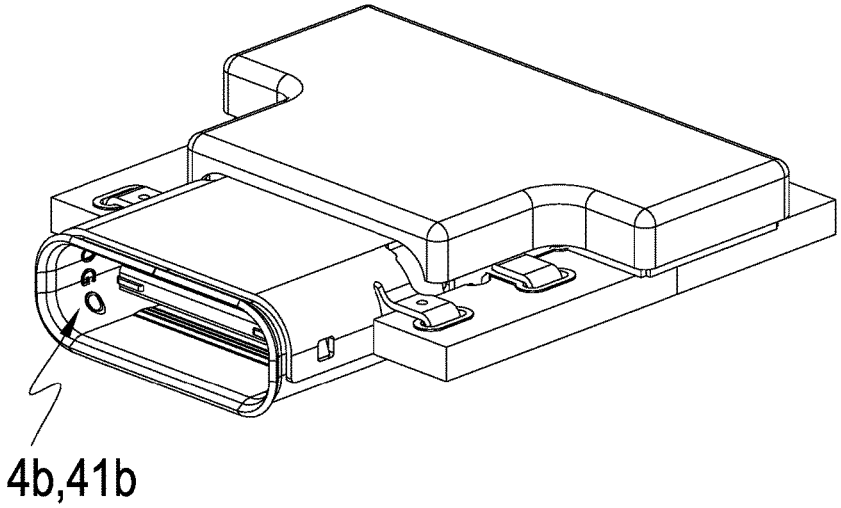
FIG. 7 is a perspective view of still another preferred embodiment of the present invention.

Referring to FIG. 7, which is a perspective view of still another preferred embodiment of the present invention, it is clearly seen from the figure that the present embodiment is similar to the embodiments mentioned above except second protrusions 3*b* include a second graphic portion 31*b* in the present embodiment, allowing the appearance of the second protrusions 3*a* to have a different appearance modeling, where the second graphic portion 31*b* may be presented as a trademark logo to generate a certain degree of advertising benefit.

The present invention has the following advantages compared with the prior art:

1. the contact areas formed by the first protrusions 3 and second protrusions 4 are larger and more uniform, capable of providing good insertion stability; and 2. the multi-step protrusions formed on the inner side wall of the metal shell 2 are used to block noise continuously.

We claim:

1. An electric connector structure, being a female connector, comprising:

a metal shell, comprising an upper surface defined on an inner side of thereof, two side surfaces extended from two respective end edges of said upper surface opposite to each other, and a lower surface extended from one side of each said side surface far away from said upper surface;

a plurality of first protrusions, respectively formed on said upper surface and lower surface; and a plurality of second protrusions, respectively formed on said two side surfaces and staggered with said first protrusions;

wherein the upper surface, a first one of the two side surfaces, the lower surface, and a second one of the two side surfaces are sequentially connected one by one to form a circumferential closed loop having a hollow interior space, the metal shell having a front opening formed in a front end in an axial direction and adapted to receive a male connector to insert, in the axial direction, into an interior space of the closed loop of the metal shell; and wherein the plurality of first protrusions are each extended in a circumferential direction and the plurality of the second protrusions are each extended in the circumferential direction, the plurality of first protrusions and the plurality of second protrusions being staggered with respect to each other in the axial direction.

2. The structure according to claim 1, wherein said first and second protrusions are in contact with an outer side wall of said male connector when said male connector is inserted in said female connector.

3. The structure according to claim 1, wherein said first protrusions comprise a first graphic portion.

4. The structure according to claim 1, wherein said second protrusions comprise a second graphic portion.

5. The structure according to claim 1, wherein said first protrusions are formed on said upper surface and lower surface symmetrically, and said second protrusions said two side surfaces symmetrically.

6. The structure according to claim 1, wherein said first protrusions and second protrusions are in electric connection with a grounding portion.

7. The structure according to claim 6, wherein said grounding portion is configured on a circuit board.

* * * * *